US009016905B1

(12) United States Patent
Butler

(10) Patent No.: US 9,016,905 B1
(45) Date of Patent: Apr. 28, 2015

(54) DECORATIVE REPLACEMENT COVER WITH ONYX LENS FOR RECESSED LIGHT FIXTURE IN WALL OR STAIR RISER

(76) Inventor: Gary Y. Butler, Coto de Caza, CA (US)

( * ) Notice: Subject to any disclaimer, the term of this patent is extended or adjusted under 35 U.S.C. 154(b) by 397 days.

(21) Appl. No.: 13/530,010

(22) Filed: Jun. 21, 2012

Related U.S. Application Data

(60) Provisional application No. 61/502,830, filed on Jun. 29, 2011.

(51) Int. Cl.
*F21V 15/00* (2006.01)
*F21V 21/04* (2006.01)

(52) U.S. Cl.
CPC ..... *F21V 21/04* (2013.01)

(58) Field of Classification Search
CPC ..... F21V 21/04; F21S 8/02; F21S 8/026
USPC ..... 362/365, 147, 249.02, 371, 373
See application file for complete search history.

(56) References Cited

U.S. PATENT DOCUMENTS 8,251,552 B2 * 8/2012 Rooms et al. ..... 362/365
2009/0116241 A1 * 5/2009 Ashoff et al. ..... 362/253

* cited by examiner

*Primary Examiner* — Joseph L Williams
(74) *Attorney, Agent, or Firm* — Jerry Turner Sewell

(57) ABSTRACT

A cover for a recessed light fixture includes a base plate mounted on a surface such that an outer perimeter of the base plate surrounds the recessed light fixture. A lens frame is removably secured to the base plate. The lens frame includes a recess that receives an onyx lens that is sized and shaped to fit within the recess. The onyx lens is secured between a lens border of the lens frame and the outer perimeter of the base plate so that the onyx lens is positioned over the recessed light fixture. Light from a lamp within the recessed light fixture passes through the onyx lens and is emitted from a polished surface of the onyx lens to provide a pleasing decorative glow for illuminating a step or other passageway.

11 Claims, 3 Drawing Sheets

FIG. 4
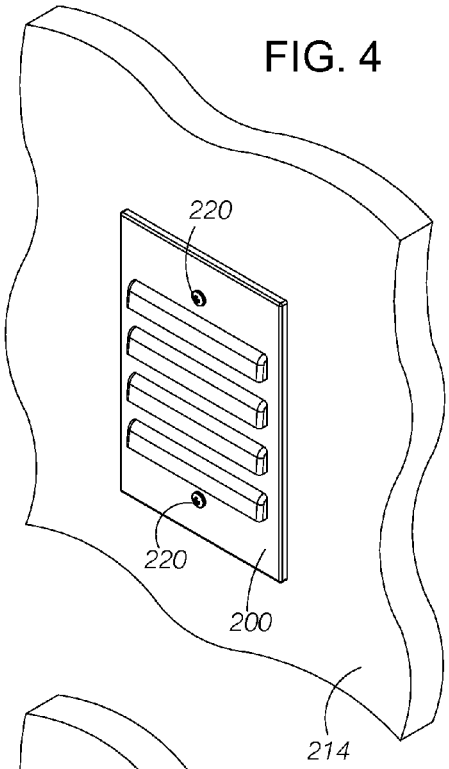
FIG. 5
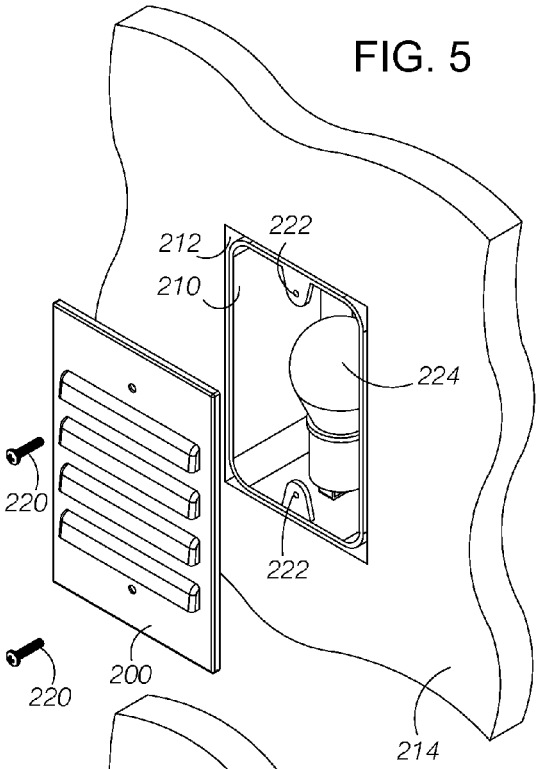
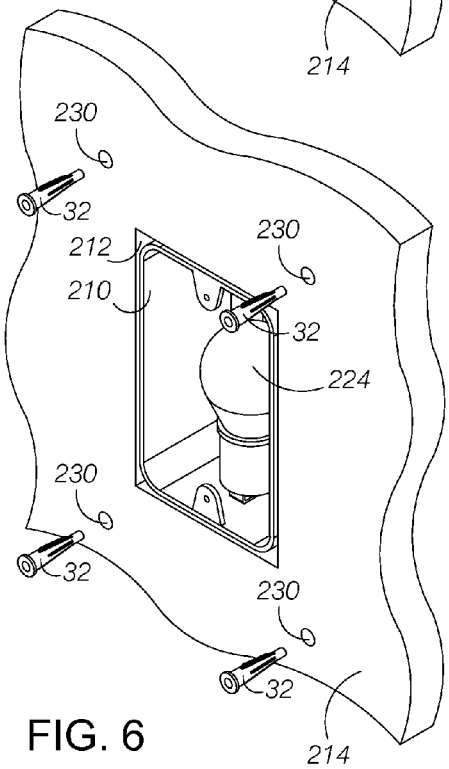
FIG. 6
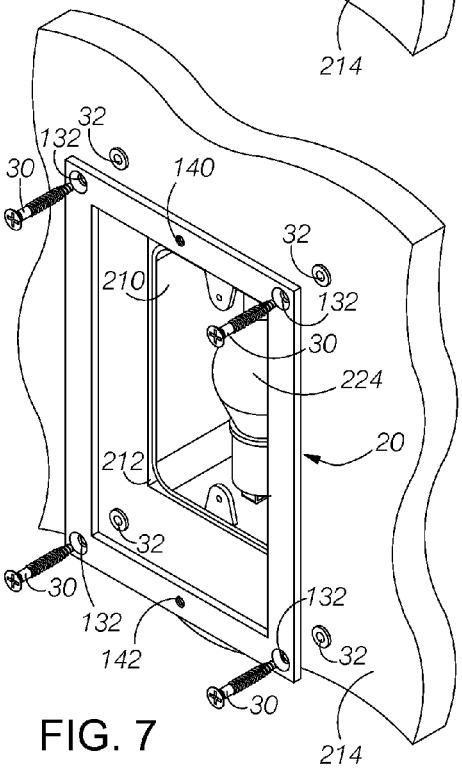
FIG. 7

FIG. 8
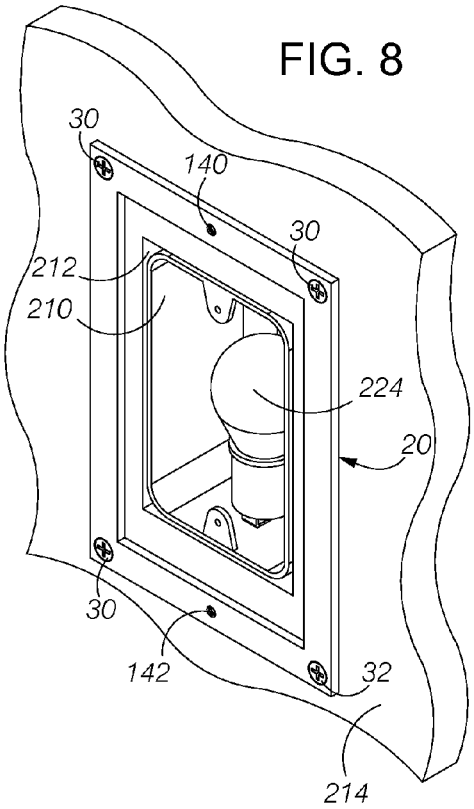
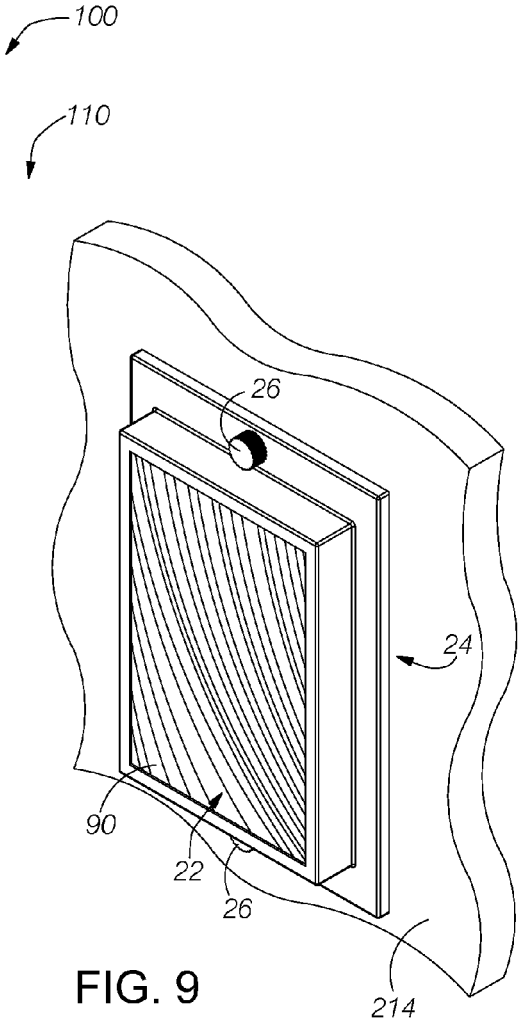
FIG. 9

DECORATIVE REPLACEMENT COVER WITH ONYX LENS FOR RECESSED LIGHT FIXTURE IN WALL OR STAIR RISER

RELATED APPLICATIONS

The present application claims the benefit of priority under 35 USC §119(e) to U.S. Provisional Application No. 61/502,830 filed on Jun. 29, 2011.

BACKGROUND OF THE INVENTION

1. Field of the Invention

The present invention is in the field of lighting fixtures for residences and commercial properties, and, more particularly, is in the field of covers for recessed lighting fixtures for stairways, hallways and other walking areas.

2. Description of the Related Art

Many residences and commercial properties have stairways, hallways and other walking areas that are lighted by recessed low wattage fixtures placed low on the wall or column or placed in a stair riser to provide lighting with low illumination so that a person can see the portion of the floor, walkway or the step without illuminating the entire hall, the walkway or stairway. Some conventional fixtures are covered with a plastic or metallic plate having a louvered grill that directs the light downward towards the area where a person steps. Other conventional fixtures include rectangular or round frames that hold frosted glass or plastic lenses of corresponding shapes. Although such louvered plates or lenses are functional, the plates and lenses are generally not attractive and do not add to the decor of a residence or commercial property.

SUMMARY OF THE INVENTION

A need exists for a cover for a recessed light fixture that is decorative as well as functional. Furthermore, it is desirable that the cover can be easily attached to an existing recessed light fixture to replace an existing louvered plate or an existing frosted glass or plastic lens. The cover disclosed herein comprises three easily installed components. A support bracket is mounted on the wall, column or stair riser surrounding the opening of a recessed step light fixture from which the conventional louvered plate or frosted glass or plastic lens frame has been removed. The support bracket does not require any connection to the recessed light fixture and can be installed without requiring any manipulation of the electrical wiring of the recessed light fixture. The support bracket provides a base for engaging a decorative cover frame that is also the frame for an onyx stone lens. In particular, the decorative cover frame is sized to fit onto the support bracket and to be secured thereto with thumb screws so that no tools are required to attach or detach the cover frame. In an illustrated embodiment, the onyx stone lens has a thickness of approximately ⅜ inch. Preferably, the stone lens comprises a naturally occurring "Honey Onyx" that is translucent. The thickness and color of the translucent stone filters the light from the source (e.g., an incandescent, fluorescent or light emitting diode (LED) lamp) within the recessed light fixture. The filtered light provides a beautiful warm glow that illuminates the desired area on the step or other walkway while adding to the ambience of the stairway, hallway or other walkway where the recessed light fixture is located. Each onyx stone lens is unique with no two lenses being identical. Thus, each cover is a "one-of-a-kind" design. The cover for the recessed light fixture allows a homeowner or a business to easily transform outdated step lights and other recessed light fixtures into a unique and attractive design using a product that is affordable and simple to install and that provides immediate and dramatic results.

An aspect of embodiments in accordance with the present invention is a cover for a recessed light fixture mounted in a fixture enclosure embedded in a fixture opening in a wall, a column or a stair riser. The cover comprises a base plate, a lens frame and an onyx lens. The base plate has an outer perimeter surrounding a central opening. The central opening is sized to be larger than the fixture opening such that the outer perimeter entirely surrounds the fixture opening. The base plate includes openings formed in the perimeter to accommodate fasteners to secure the base plate to the wall, the column or the stair riser. The lens frame has a base portion sized to fit around the outer perimeter of the base plate and has a lens support portion extending from the base portion. The lens support portion includes a lens receiving recess have a selected size and shape. The lens receiving recess has a view opening disposed away from the base portion. The view opening is surrounded by a lens border. The lens comprises a slab of onyx cut to a size and shape to fit within the recess of the lens frame. The lens has a polished face that highlights the naturally occurring colors of the onyx. The lens is positioned in the lens receiving recess of the lens frame with a perimeter portion of the lens adjacent the border surrounding the view opening and with the remaining portion of the polished face exposed through the view opening of the lens receiving recess. Thus, light incident on a face opposite the polished face is emitted from the remaining portion of the polished face and passes through the view opening.

Preferably, the base portion of the lens frame includes at least one fastener to fasten the lens frame to the base portion. Also preferably, the at least one fastener comprises a thumbscrew having a threaded shaft that passes through a bore in the lens frame and that engages a threaded bore in the base plate. More preferably, the at least one fastener comprises two thumbscrews that pass through bores formed symmetrically about a center of the lens frame and that engage corresponding threaded bores in the base plate.

In preferred embodiments, the slab of onyx forming the lens comprises "honey onyx." In certain embodiments, the slab of onyx forming the lens has a thickness of approximately ⅜ inch. Preferably, the slab of onyx forming the lens is generally rectangular with a front surface, a rear surface, a first edge surface, a second edge surface, a third edge surface and a fourth edge surface. Preferably, only the front surface is polished to form the polished face. In certain embodiments, when the lens frame is secured to the base plate, the lens positioned in the lens receiving recess is secured within the lens receiving recess between the lens border of the view opening and the outer perimeter of the base plate.

Another aspect of embodiments in accordance with the present invention is a method of installing a cover over a recessed light fixture. The method comprises removing any existing cover from the recessed light fixture. A base plate is secured to the surface surrounding the recessed light fixture. The base plate is generally centered with respect to the recessed light fixture. The base plate includes an outer perimeter that surrounds a central opening. The recessed light fixture is accessible via the central opening. An onyx lens is inserted into a lens frame. The onyx lens is sized and shaped to fit within a recess in the lens frame. The recess has a viewing opening surrounded by a lens border. The onyx lens is positioned in the recess with a perimeter of a polished surface of the onyx lens against the lens border and with the remaining portion of the polished surface exposed through the viewing opening. The lens frame is secured to the base plate. The lens frame is positioned with respect to the base plate such that the onyx lens is positioned between the lens border of the lens frame and the outer perimeter of the base plate such that the onyx lens is positioned over the recessed light fixture. In preferred embodiments, the onyx lens comprises "honey onyx."

Preferably, the lens frame is removably secured to the base plate via at least one thumbscrew having a threaded shaft that passes through a bore in the lens frame and engages a threaded bore in the base plate.

BRIEF DESCRIPTION OF THE DRAWINGS

Embodiments in accordance with aspects of the present invention are described below in connection with the attached drawings in which:

FIG. 4 illustrates an existing step light fixture having a louvered cover positioned over the recessed light fixture;

FIG. 5 illustrates the first step of removing the existing louvered cover to expose the recessed light fixture within an opening in the wall, column or step riser;

FIG. 6 illustrates the step of forming holes in the wall, column or step riser in a rectangular pattern surrounding the recessed light fixture;

FIG. 7 illustrates the optional step of inserting wall anchors (e.g., expandable plastic mollies) into the holes in the wall, column or step riser;

FIG. 8 illustrates the step of fastening the base plate to the wall, column or step riser so that the base plate surrounds the recessed light fixture; and FIG. 9 illustrates the final step of securing the lens frame and onyx lens of FIG. 3 to the base plate using the thumbscrews.

DETAILED DESCRIPTION OF PREFERRED EMBODIMENTS

The step light cover is disclosed herein with respect to exemplary embodiments. The embodiments are disclosed for illustration of the cover for a recessed light fixture and are not limiting except as defined in the appended claims. The embodiments are described herein with respect to a recessed light fixture positioned in the riser of a step or in a wall proximate to a step; however, it should be understood that the embodiments may also be used with other recessed light fixtures for lighting walkways such as hallways, outdoor pathways and the like wherein the light fixtures may be installed in indoor or outdoor walls or columns or other structures.

Figure 1:
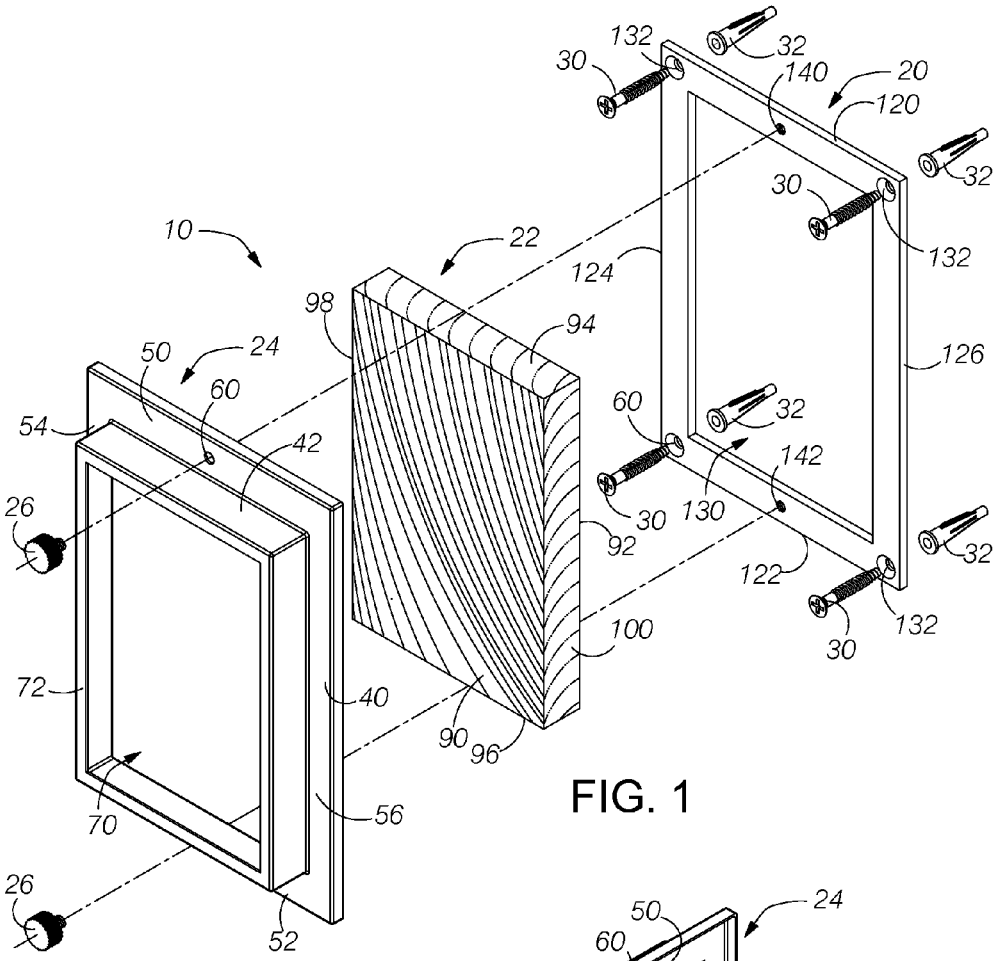
FIG. 1 illustrates a front perspective view of the components of the cover prior to installation of the cover over an existing recessed light fixture showing the base plate, the onyx lens, the lens frame, the thumbscrews, the base installation screws and optional wall anchors (mollies)

FIG. 1 illustrates a front perspective view of the components of a cover 10 prior to installation of the cover over an existing recessed light fixture. Preferably, the cover is provided as a kit having the components shown in FIG. 1. In the illustrated embodiment, the cover comprises a base plate 20, an onyx lens 22, a lens frame 24, a pair of thumbscrews 26, a set of base installation screws 30 and an optional set of wall anchors (mollies) 32.

In the illustrated embodiment, the lens frame 24 is rectangular and is formed as a frame base portion 40 and a frame raised portion 42. The frame base portion has a height of approximately ¼ inch, and the frame raised portion has a height of approximately ⅜ inch. The frame base portion has an outer width of approximately 4¼ inches and has an outer length of approximately 6¼ inches. The frame raised portion is generally centered on the frame base portion has an outer width of approximately 3¾ inches and an outer length of approximately 5 inches. Thus, the frame base portion forms a border around the frame raised portion. An upper portion 50 of the border extends approximately ⅝ inch above the frame raised portion; and a lower portion 52 of the border extends approximately ⅝ inch below the frame raised portion. A left portion 54 of the border extends horizontally approximately ¼ inch to the left of the frame raised portion; and a right portion 56 of the border extends approximately ¼ inch to the right of the frame raised portion. (As used herein "upper," "lower," "left" and "right" refer to the orientation shown in FIG. 1, and are not intended to limit the positioning of the lens frame to a particular orientation.)

A first through bore 60 is formed in the upper portion 50 of the border approximately 3/16 inch from the upper edge of the lens frame 24 and is centered with respect to the right and left edges of the lens frame. A second through bore 62 (see FIGS. 2 and 3) is formed in the lower portion 52 of the border approximately 3/16 inch from the lower edge of the lens frame and is also centered with respect to the left and right edges of the lens frame. Thus, the two through bores are positioned approximately 5⅝ inches apart center-to-center. In the illustrated embodiment, the through bores have diameters of approximately ¼ inch. Preferably, the two through bores are disposed vertically by substantially equal distances from the center of the lens frame.

The raised portion 42 of the lens frame 24 has a rectangular opening 70 formed substantially in the center. The rectangular opening has a width of approximately 3¼ inches and has a length of approximately 4½ inches. Thus, the frame raised portion forms a lens border 72 having a width of approximately ¼ inch around the four edges of the rectangular opening. As described below, the rectangular opening is a view opening for the onyx lens 22 when the onyx lens is installed in the lens frame.

In the illustrated embodiment, the lens frame 24 is formed from metal such as steel or aluminum having a thickness corresponding to 22 gauge steel (approximately 0.0285 to 0.0314 inch) and is painted, anodized or otherwise coated with a decorative finish. Alternatively, the lens frame may be formed from a suitable plastic or other material, which may have a different thickness.

Figure 2:
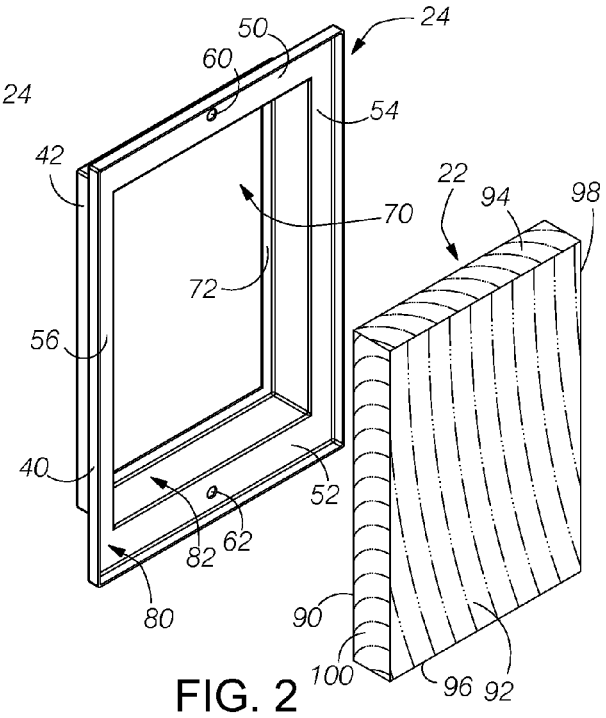
FIG. 2 illustrates a rear perspective view of the lens frame and the onyx lens of FIG. 1 showing the onyx lens prior to being positioned within the lens frame.

As shown in the rear perspective view of FIG. 2, the lens frame 24 has a first recessed portion 80 corresponding to the border around the frame raised portion 42 and has a second recessed portion 82 corresponding to the lens border 72 around the rectangular view opening 70. The first recessed portion has a depth of approximately 3/16 inch, which corresponds to the ¼-inch height of the frame base portion 40 less the thickness of the metal (or other material) and the thickness of any coating. The first recessed portion has an inside length that is slightly greater than 6 3/16 inches and has an inside width that is slightly greater than 4 3/16 inches. The second recessed portion has a depth of approximately ⅜ inch corresponding to the height of the frame raised portion 42 because the thickness of the raised frame portion is offset by the thickness of the frame base portion. The second recessed portion has a width of approximately 3⅝ inches and has a length (in the vertical direction in the drawings) of approximately 4⅞ inches.

The onyx lens 22 comprises a slab of naturally occurring onyx, which is formed of bands of chalcedony in alternating colors. In a preferred embodiment, the onyx lens comprises "honey onyx," which has warm tones of orange, gold and yellow, with each slab having distinctive patterning so that each lens is unique. The onyx lens may also comprise other types of onyx with different colors and with different color patterns. Accordingly, it should be understood that the banding pattern shown in the drawings is only representative of a very large number of different naturally occurring color patterns that are generally irregular.

The onyx lens 22 is shaped and sized to fit within the second recessed portion 82 of the lens frame 24. As shown in FIGS. 1 and 2, the onyx lens is generally rectangular in the illustrated embodiment and has a front surface 90, a rear surface 92, an upper surface 94, a lower surface 96, a left surface 98 and a right surface 100. The lower surface is substantially similar to the upper surface, and the left surface is substantially similar to the right surface.

Figure 3:
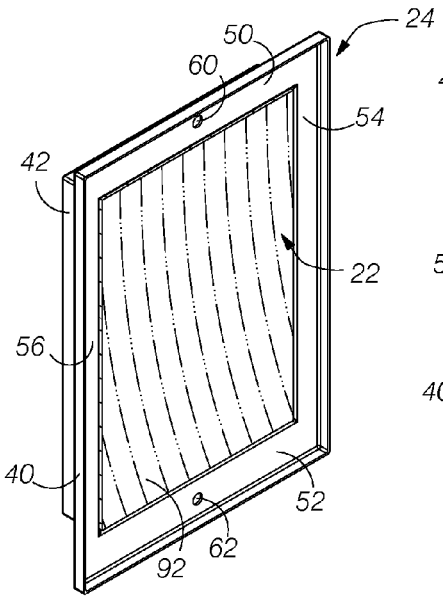
FIG. 3 illustrates a rear perspective view of the lens frame and the onyx lens of FIG. 2 showing the onyx lens positioned within the lens frame.

The onyx lens 22 has a thickness between the front surface 90 and the rear surface 92 of approximately ⅜ inch, which is approximately the same as the depth of the second recessed portion 82. The onyx lens has a width between the left surface 98 and the right surface 100 of approximately 3½ inches. The onyx lens has a length (in the vertical direction in the drawings) between the upper surface 94 and the lower surface 96 of approximately 4¾ inches. Thus, the onyx lens fits within the second recessed portion of the lens frame with the rear surface of the onyx lens approximately flush with the bottom of the first recessed portion 80, as shown in FIG. 3. As shown in FIG. 9, when the onyx lens is positioned in the lens frame, an outer perimeter portion of the front surface of the onyx lens is positioned against the lens border 72 with the remaining portion of the onyx lens exposed through the view opening 70.

In the illustrated embodiment, the front surface 90 of the onyx lens 22 is polished to form a polished face that highlights the naturally occurring pattern of colored bands or other structures of the onyx. The other five surfaces (the rear, upper, lower, left and right surfaces) of the onyx lens may also be polished; however, in the illustrated embodiment, the other five surfaces remain in the initial saw-cut state as represented by the arcuate phantom lines on the surfaces. The unpolished surfaces are not visible in the installed onyx lens and do not detract from the appearance of the finished surface. In addition, the saw marks on the rear surface 92 may also serve to diffuse the light as it passes through the onyx lens from the rear surface to the front surface, as described below.

As further shown in FIG. 1, the base plate 20 is generally rectangular and has upper edge 120, a lower edge 122, a left edge 124 and a right edge 126. In the illustrated embodiment, the upper edge and the lower edge are spaced apart by a length that is slightly less than approximately 6⅛ inches. The left edge and the right edge are spaced apart by a width of slightly less than approximately 4³⁄₁₆ inches. Accordingly, the base plate is sized to fit within the first recessed portion 80 of the lens frame 24. Preferably, the base plate has a thickness of approximately ⅛ inch. In the illustrated embodiment, the base plate comprises brass; however, other suitable metallic or nonmetallic materials may also be used.

The base plate 20 has a rectangular opening 130 formed in the central portion. The rectangular opening has a width of approximately 3³⁄₁₆ inches and has a length of approximately 5³⁄₁₆ inches. Thus, the remaining portions of the base plate form an outer perimeter around the rectangular opening.

The base plate 20 includes a respective countersunk bore 132 in each of the four corners with the center of each bore disposed approximately ⁵⁄₁₆ inch from each of the two nearest edges. In the illustrated embodiment, the centers of the four countersunk bores are spaced apart by 3⁹⁄₁₆ inches horizontally and by 5⁹⁄₁₆ inches vertically. In the illustrated embodiment, the diameter of the non-countersunk portion of each bore is approximately ³⁄₁₆ inch. The spacing can be varied from the illustrated embodiment.

The base plate 20 includes a first threaded bore 140 and a second threaded bore 142. The first threaded bore is positioned between the top of the rectangular opening 130 and the upper edge 120. The second threaded bore is positioned between the bottom of the rectangular opening and the lower edge 122. The centers of the threaded bores are positioned approximately 5⅝ inches apart to match the spacing of the through bores 60 and 62 of the lens frame 24. The threads of the threaded bores are selected to match the threads on the thumbscrews 26. In the illustrated embodiment, the thumbscrews have a shaft length of approximately ¼ inch and are threaded with conventional 6-32 threads.

The cover 10 disclosed herein is preferably used to replace an existing cover over a recessed light fixture, such as for example, a louvered cover 200 shown in FIG. 4. The louvered cover is positioned over an existing recessed light fixture 210 (FIG. 5), which is positioned in an opening 212 in a wall, a column or a stair riser 214. A portion of the wall, column or stair riser surrounding the recessed light fixture is shown in FIGS. 4-9. It should be understood that in some installations, the recessed light fixture is positioned in a wall alongside a flight of stairs. In other installations, the recessed light fixture is positioned in a riser to illuminate the step immediately below the riser. In other installations, the recessed light fixture may be installed in a column or other structure proximate to a walkway. The recessed light fixture may be installed in either indoor or outdoor locations. The cover may be used in many types of installations. It should be further understood that although the recessed light fixture is oriented vertically in FIGS. 4-9, the cover disclosed herein may also be installed over recessed light fixtures that are oriented horizontally.

Although described herein with respect to the replacement of a cover on an existing recessed light fixture, it should be understood that the cover 10 may also be installed over a recessed light fixture in new construction as will be apparent from the following description.

As shown in FIG. 5, the first step in replacing an existing cover 200 for a recessed light fixture with the cover 10 of FIGS. 1-3 is to remove the existing cover by disengaging a pair of screws 220 from the threaded holes 222 in the mounting tabs of the recessed light fixture 210 to release the cover and expose the existing recessed light fixture. For new construction where no cover has been attached to the recessed light fixture, the step shown in FIG. 5 is not necessary. After removing the existing cover, a bulb 224 or other lighting component can be replaced if desired. For example, an incandescent bulb can be replaced with a lower wattage LED bulb, or the like, having a mounting base common to the mounting base of the existing bulb.

In the next step illustrated in FIG. 6, four holes 230 are formed in the wall, column or step riser 214 in a rectangular pattern surrounding the recessed light fixture 210. Preferably, the rectangular pattern is symmetrical about the center of the recessed light fixture. A template (not shown) can be provided to indicate the locations of the four holes. Alternatively, the base plate 20 can be positioned temporarily around the recessed light fixture so that the countersunk bores 132 can be used as a template to mark the positions of the four holes. The holes are then drilled in the wall, column or step riser at the marked locations.

When the recessed light fixture is mounted in a wall 214 comprising wallboard, the holes 230 are drilled to the diameter specified for the size of the wall anchor mollies 32. For some installations (for example, when the recessed light fixture is mounted in a solid wood stair riser), the wall anchor mollies may not be necessary, and the holes are drilled with a pilot hole selected for the size of the base installation screws 30. For example, in the illustrated embodiment, the base installation screws are #8 wood screws, and a ⅛ inch pilot hole is advantageous.

For the wallboard installation, the wall anchor mollies 32 are positioned in the holes 230 as shown in FIG. 7. The countersunk bores 132 in the base plate 20 are aligned with the mollies, and the base installation screws 30 are inserted through the countersunk bores and into the mollies. The base installation screws are then tightened to secure the base plate to the wall or stair riser 214, as shown in FIG. 8. If the wall anchor mollies are not used, the base installation screws are screwed directly into the pilot holes formed in the wall.

After securing the base plate 20 to the wall 214 as shown in FIGS. 7 and 8, the lens frame 24 and the lens 22 are positioned over the base plate, and the lens frame is secured to the base plate by engaging the thumbscrews 26 into the threaded bores 140, 142 as shown in FIG. 9. Prior to positioning the lens frame and lens over the base plate, the lens is positioned in the lens frame as shown in FIG. 3. Although the onyx lens may be shipped to a distributor and to an end user separate from the lens frame, as shown in FIG. 1, in certain preferred embodiments, the onyx lens is secured to the lens frame using an adhesive or other suitable means of attachment prior to shipping so that the end user does not have to handle the onyx lens during the installation process. Accordingly, when the lens frame is secured to the base plate, the lens is sandwiched between the border 72 of the lens frame and the base plate. A substantial portion of the front surface 90 of the lens is exposed via the rectangular opening in the lens frame.

After the installation is completed as shown in FIGS. 4-9, the recessed light fixture 210 operates as before; however, the light provided by the recessed light fixture is now filtered through the lens 22 of the cover 10 to provide a warm glow rather than the harsh lighting provided by a conventional recessed light fixture.

As set forth above, the installation does not require any modification of the existing recessed light fixture 210 and does not present any risk of electrical shock because the existing electrical wiring to the recessed light fixture is not modified during the installation of the cover 10. If the bulb 224 needs to be replaced after installation of the cover, the lens frame 24 and the lens 22 are easily removed by disengaging the thumbscrews 26 to provide access to the bulb.

It should be understood that although described herein with respect to a rectangular cover 10 installed with the longest edge oriented vertically, the cover may also be installed in other orientations (e.g., horizontal or at an angle) to accommodate the positioning of the recessed light fixture 210 over which the cover is installed. Furthermore, the cover may also be configured as a square to accommodate a recessed light fixture having a wider enclosure. The cover may also be configured in other shapes to provide additional decorative options. For outdoor installations or other installations where the cover may be exposed to water, a suitable gasket, caulking or other material can be provided to seal the lens frame to the wall, column or step riser to inhibit water intrusion.

As various changes could be made in the above constructions without departing from the scope of the invention, it is intended that all the matter contained in the above description or shown in the accompanying drawings shall be interpreted as illustrative and not in a limiting sense.

What is claimed is:

1. A cover for a recessed light fixture mounted in a fixture enclosure embedded in a fixture opening in a wall or a stair riser, comprising:

a base plate having an outer perimeter and an inner perimeter, the inner perimeter defining a central opening in the base plate, the central opening sized to be larger than the fixture opening in the wall or the stair riser such that the base plate is positionable on the wall or the stair riser with the inner perimeter of the base plate spaced apart from the fixture enclosure embedded in the fixture opening with no portion of the base plate contacting the fixture enclosure, the base plate including openings formed between the outer perimeter and the inner perimeter to accommodate fasteners to secure the base plate to the wall or the stair riser;

a lens frame having a base portion sized to fit around the outer perimeter of the base plate and having a lens support portion extending from the base portion, the lens support portion including a lens receiving recess having a selected size and shape, the lens receiving recess having a view opening disposed away from the base portion, the view opening surrounded by a lens border; and a lens comprising a slab of onyx cut to a size and shape to fit within the recess of the lens frame, the lens having a polished face that highlights the naturally occurring colors of the onyx, the lens positioned in the lens receiving recess of the lens frame with a perimeter portion of the lens adjacent the border surrounding the view opening and with the remaining portion of the polished face exposed through the view opening of the lens receiving recess so that light incident on a face opposite the polished face is emitted from the remaining portion of the polished face and passes through the view opening.

2. The system as defined in claim 1, wherein the base portion of the lens frame includes at least one fastener to fasten the lens frame to the base plate.

3. The system as defined in claim 2, wherein the at least one fastener comprises a thumbscrew having a threaded shaft that passes through a bore in the lens frame and that engages a threaded bore in the base plate.

4. The system as defined in claim 2, wherein the at least one fastener comprises two thumbscrews that pass through bores formed symmetrically about a center of the lens frame and that engage corresponding threaded bores in the base plate.

5. The system as defined in claim 1, where the slab of onyx forming the lens comprises "honey onyx."

6. The system as defined in claim 1, wherein the slab of onyx forming the lens has a thickness of approximately ⅜ inch.

7. The system as defined in claim 1, wherein the slab of onyx forming the lens is generally rectangular with a front surface, a rear surface, a first edge surface, a second edge surface, a third edge surface and a fourth edge surface, and wherein only the front surface is polished to form the polished face.

8. The system as defined in claim 1, wherein when the lens frame is secured to the base plate, the lens positioned in the lens receiving recess is secured within the lens receiving recess between the lens border of the view opening and the base plate.

9. A method of installing a cover over an existing recessed light fixture in a wall or stair riser, the method comprising:

removing any existing cover from the recessed light fixture;

securing a base plate to a surface of the wall or stair riser surrounding the recessed light fixture, the base plate approximately centered with respect to the recessed light fixture, the base plate including an inner perimeter that surrounds a central opening, the recessed light fixture being accessible via the central opening, the inner perimeter of the base plate sized and shaped to be greater than outer dimensions of the recessed light fixture so that when the base plate is secured to the surface, the inner perimeter is spaced apart from the recessed light fixture with no portion of the base plate contacting the recessed light fixture; and securing a lens frame to the base plate, the lens frame including a recess, the recess having a viewing opening surrounded by a lens border, the lens frame further including an onyx lens sized and shaped to fit within the recess, the onyx lens having a polished surface with a perimeter portion of the onyx lens positioned against the lens border such that a central portion of the polished surface is exposed through the viewing opening, the lens frame positioned with respect to the base plate such that the onyx lens is positioned between the lens border of the lens frame and the base plate and such that the onyx lens is positioned over the step light fixture.

10. The method as defined in claim 9, wherein the lens frame is removably secured to the base plate via at least one thumbscrew having a threaded shaft that passes through a bore in the lens frame and engages a threaded bore in the base plate.

11. The method as defined in claim 9, wherein the onyx lens comprises "honey onyx."

* * * * *